United States Patent [19]

Dieser

[11] Patent Number: 4,481,803

[45] Date of Patent: Nov. 13, 1984

[54] METHOD FOR ELIMINATING DISTORTION AT THE END OF A TUBE BEND

[75] Inventor: John J. Dieser, Aurora, Ill.

[73] Assignee: Teledyne Industries, Inc., Los Angeles, Calif.

[21] Appl. No.: 476,768

[22] Filed: Mar. 18, 1983

[51] Int. Cl.[3] ..... B21D 9/05

[52] U.S. Cl. ..... 72/150; 72/370

[58] Field of Search ..... 72/149, 150, 369, 370, 72/398, 466, 465

[56] References Cited

U.S. PATENT DOCUMENTS 1,903,436 4/1933 Brown ..... 72/369

3,155,139 11/1964 Hautau ..... 72/150

4,085,608 4/1978 Franks et al. ..... 72/150 X

FOREIGN PATENT DOCUMENTS 49157 4/1976 Japan ..... 72/150

79026 5/1982 Japan ..... 72/150

*Primary Examiner*—E. Michael Combs

*Attorney, Agent, or Firm*—Wood, Dalton, Phillips, Mason & Rowe

[57] ABSTRACT

A tube is bent a desired angle by locating it over a mandrel, clamping the tube between a clamp die and bend die, rotating the clamp and bend dies through the desired angle, where extraction of the mandrel from the tube is initiated before rotation of the dies is completed.

6 Claims, 6 Drawing Figures

METHOD FOR ELIMINATING DISTORTION AT THE END OF A TUBE BEND

BACKGROUND OF THE INVENTION

1. Technical Field

This invention relates to a method for bending a tube and more particularly to a method for eliminating distortion at the end of a tube bend.

2. Background Art

Tube bending is well known in the art. Typically, machines for tube bending include a bending head having a bend die, a pressure die, a clamp die and a wiper die. Many machines also include a carriage which positions a tube with respect to the bending head and a numerical control which controls the various parts of the machine to bend a tube to a particular desired configuration. The known operation of the bending head is described more fully with reference to FIG. 1 in the Description of the Preferred Embodiment.

In mandrel-type tube bending, a mandrel is placed within the tube with the mandrel head at the point of tangency of the tube with the bend die. The tube is drawn over the mandrel as the tube is bent (i.e. as the bend and clamp dies are rotated), and the mandrel head thus helps to maintain the proper cross-sectional configuration of the tube through the bend. This is particularly important in bending tubes having relatively thin walls. Flexible mandrels are also used, having multiple ball links mounted to the end of the mandrel head and which thus extend within the tube beyond the point of tangency, to still further ensure maintenance of the proper cross-sectional configuration.

However, even with mandrel-type tube benders, the tubes when bent generally have a deformation in the wall at the outer radius at the end of the bend. The deformation is unattractive and the distortion may weaken the tube. Still further, the deformation results in non-uniformity of the interior surface of the tube, thereby causing flow turbulence which not only decreases efficiency of flow through the tube but also creates an accumulation point for contaminants.

The present invention is directed toward overcoming one or more of the problems as set forth above.

SUMMARY OF THE INVENTION

In one aspect of the present invention, extraction of the mandrel from a bent tube is initiated before the bend is completed. More particularly, a tube is bent a desired angle by locating it over a mandrel, clamping the tube between a clamp die and bend die, rotating the clamp and bend dies through the desired angle, where extraction of the mandrel from the tube is initiated before rotation of the dies is completed.

By bending a tube with this method, the irregular distortion found at the outer radius at the end of a bend in a tube bent through conventional methods is eliminated. Elimination of this distortion thus increases the efficiency of flow through such tubes and removes an accumulation point for contaminants.

DESCRIPTION OF THE PREFERRED EMBODIMENT

Figure 1A:
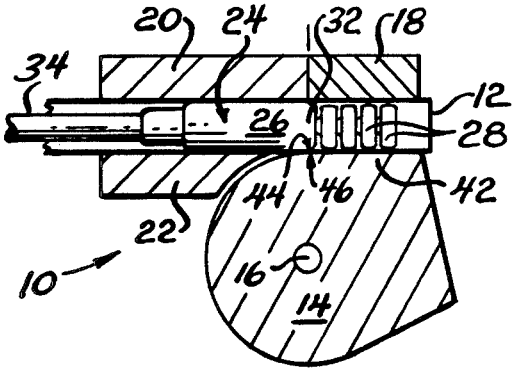
FIGS. 1*a*–1*c* are cross-sectional views of a bending head having a mandrel and showing the head in successive positions in the steps of the described bending method.
Figure 1B:
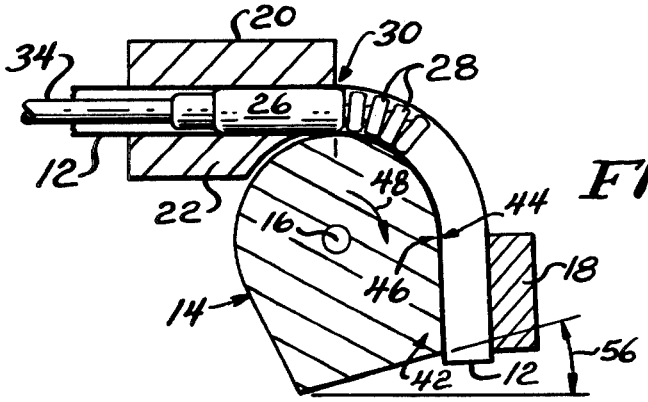
Figure 1C:
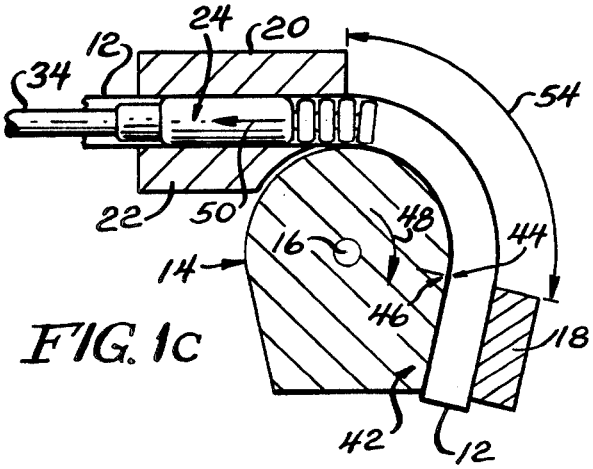

FIGS. 1*a*–1*c* illustrate a typical bend head 10 with a bent tube 12. The bend head includes a bend die 14 rotatable about a shaft 16 and a clamp die 18 which clamps the forward end of the tube 12 to the bend die 14. A pressure die 20 maintains the alignment of the back portion of the tube 12 during bending and a wiper die 22 is present to prevent wrinkling on the inside radius of the tube 12.

A flexible mandrel 24 is provided inside the tube 12 with a mandrel head 26 and multiple mandrel balls 28. The forward end of the mandrel head 26 is aligned with the rear tangent point 30 (see FIG. 1*b*) of the tube 12 to the bend die 14 with a portion 32 projecting beyond the rear tangent point 30 and in the shape of half of a mandrel ball. A mandrel rod 34 extends rearwardly from the mandrel head 26 and is secured by suitable means to fix the mandrel 24 during bending.

Figure 2:
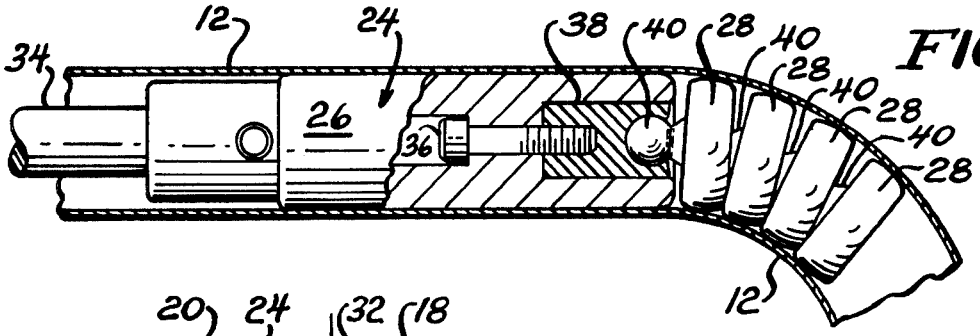
FIG. 2 is a cross-sectional view of a mandrel within a tube.

A typical flexible mandrel 24 is illustrated more fully in FIG. 2. It includds a mandrel head 26 fixed on its rear end to a mandrel rod 34. Mounted by a bolt 36 to the forward end of the mandrel head 26 is a mandrel link 38 connected to a ball link 40 in a ball and socket-type arrangement, thereby flexibly linking the mandrel ball 28 to the mandrel head 26. Any desired number of mandrel balls 28 may be serially attached in a similar manner, with the mandrel 24 shown in FIG. 2 having four. Other flexible mandrels 24, such as a link and pin mandrel of a type disclosed in U.S. Pat. No. 3,415,107, a cable mandrel, or any other suitable mandrel, may be used with the present disclosure as well.

To bend a tube 12, the bend die 14 is positioned with its forward tangent section 42 in alignment with the mandrel 24 as shown in FIG. 1*a*. The tube 12 is positioned with its desired forward tangent point 44 (see FIGS. 1*a*–1*c*) at the forward tangent point 46 of the bend die 14 and is then clamped to the bend die 14 by the clamp die 18. The pressure die 20 is also moved into position against the tube 12.

The bend die 14 and clamp die 18 are then rotated together in the direction of the arrow 48, drawing the tube 12 over the mandrel 24 and through the wiper die 22 and pressure die 20 and bending the tube 12.

In accordance with prior practice, at the completion of the bend, the mandrel 24 is generally stuck within the tube 12 (the bent tube 12 having been slightly formed around the mandrel head 26 and/or mandrel balls). Thus, after the tube has been bent through the desired bend angle 54, the mandrel 24 is retracted a distance in the direction of the arrow 50 to extract it from the bend (see FIG. 1*c*). Once retraction of the mandrel 24 is completed, the clamp die 18 is also released and returned with the bend die 14 to the initial position, at which point, the same tube 12 or a new tube can be positioned for another bend.

Figure 3:
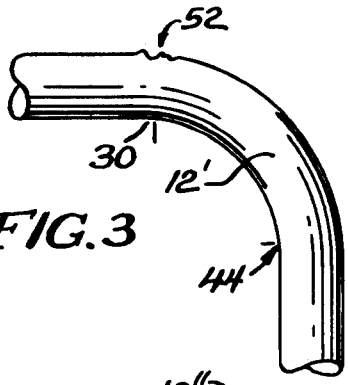
FIG. 3 is a partial view of a bent tube showing the distortion resulting from prior art bending methods.

The above described machine and bending procedure are known. However, tubes 12' bent in this manner have been found to have an irregular deformation 52 on the outer radius of the bend near the rear tangent point 30 as illustrated in FIG. 3. This deformation 52, besides effecting appearance and distorting the tube 12', causes flow turbulence within the bent tube 12' and forms an accumulation point for contaminants.

Figure 4:
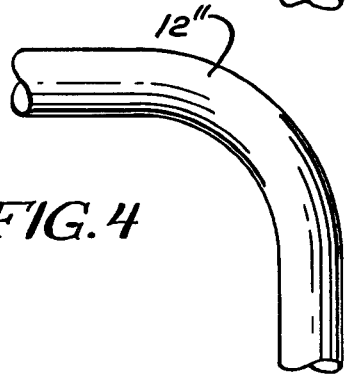
FIG. 4 is a partial view of a tube bent according to the present invention.

It has been found that initiating the extraction of the mandrel 24 before the bend is completed will eliminate the distortion 54 while still maintaining the proper cross-sectional configuration of the tube 12''. The tube 12'' is still in a ductile state at that time and drawing the mandrel 24 back through the tube 12'' smooths out the surface, leaving an ideal bend free of distortion as shown in FIG. 4.

Thus, when the bend die 14 and clamp die 18 reach the position shown in FIG. 1*b*, with an angle 56 of rotation left for completion of the desired bend angle 54, retraction of the mandrel 24 is begun. In the preferred embodiment, angle 56 is on the order of two to five degrees. Rotation of the bend die 14 and clamp die 18 should be completed before retraction of the mandrel 24 is stopped.

Other aspects, objects and advantages of the present invention can be obtained from a study of the drawings, the disclosure and the appended claims.

I claim:

1. A method for bending a tube at a desired angle, comprising the steps of:

locating the tube over a mandrel;

clamping said tube between a clamp die and a bend die;

rotating said clamp and bend dies through said desired angle to form a bend in the tube; and extracting said mandrel from said tube bend, wherein said extracting step is initiated before said die rotation is completed and continues during a remaining portion of said die rotation which completes bending of the tube.

2. The method of claim 1 wherein said extraction is initiated when said dies have between two and five degrees of rotation remaining.

3. The method of claim 1 wherein said mandrel is stationary during said clamping and rotating steps except during the last two to five degrees of rotation during said rotating step.

4. The method of claim 3 wherein said tube is drawn over said mandrel during said rotation step.

5. The method of claim 1 wherein:

said mandrel comprises a cylindrical section and flexible multiple links attached serially to an end of said cylindrical section; and said cylindrical section is, except during extraction, held with said end at the point of tangency of the tube with said bend die.

6. The method of claim 5, wherein said tube is drawn over said mandrel during said rotation step.

* * * * *